United States Patent [19]

Wyberg

[11] Patent Number: 4,869,372

[45] Date of Patent: Sep. 26, 1989

[54] GABLE-TOP CONTAINER

[75] Inventor: Gregory R. Wyberg, Minneapolis, Minn.

[73] Assignee: Minnesota Mining and Manufacturing Company, St. Paul, Minn.

[21] Appl. No.: 160,402

[22] Filed: Mar. 9, 1988

Related U.S. Application Data

[63] Continuation-in-part of Ser. No. 36,922, Apr. 10, 1987, Pat. No. 4,756,426.

[51] Int. Cl.[4] ..... B65D 5/06

[52] U.S. Cl. ..... 206/631.3; 229/3.5 R; 229/137

[58] Field of Search ..... 229/125.42, 137, 138, 229/160.2, 3.5 R; 206/621.1, 621.2, 631, 631.2, 631.3, 813; 220/457

[56] References Cited

U.S. PATENT DOCUMENTS

| | | | |
|---|---|---|---|
| 2,719,100 | 9/1955 | Banigan | 229/3.5 R |
| 2,750,095 | 6/1956 | Alden | 229/17 |
| 3,081,927 | 3/1963 | Hayhurst | 229/17 |
| 3,116,002 | 12/1963 | Crawford et al. | 229/17 |
| 3,120,089 | 2/1964 | Monroe et al. | 53/86 |
| 3,178,089 | 4/1965 | Tobias et al. | 229/17 |
| 3,192,091 | 6/1965 | Hey et al. | 206/631 |
| 3,239,995 | 3/1966 | Monroe et al. | 53/375 |
| 3,245,603 | 4/1966 | Wilcox | 229/17 |
| 3,270,940 | 9/1966 | Egleston et al. | 229/17 |
| 3,297,227 | 1/1967 | Wallsten | 229/17 G |
| 3,309,841 | 3/1967 | Egleston et al. | 53/373 |
| 3,334,799 | 8/1967 | Crawford | 229/17 |
| 3,452,919 | 7/1969 | Avolio | 229/17 |
| 3,554,430 | 1/1971 | MacEwen | 229/17 |
| 3,560,223 | 2/1971 | Turbak | 229/3.5 R |
| 3,675,015 | 7/1972 | Geib | 229/17 G |
| 3,827,625 | 8/1974 | Miller | 229/62 |
| 4,008,347 | 2/1977 | Amberg et al. | 220/457 |
| 4,211,357 | 7/1980 | Lisiecki | 229/17 G |
| 4,313,553 | 2/1982 | Lisiecki | 229/17 G |
| 4,390,121 | 6/1983 | Lisiecki | 229/17 G |
| 4,488,647 | 12/1984 | Davis | 206/631 |
| 4,527,732 | 7/1985 | Smith | 229/17 G |
| 4,576,285 | 3/1986 | Goglio | 206/632 |
| 4,712,727 | 12/1987 | Wyberg | 206/631.3 |

*Primary Examiner*—Gary Elkins

*Attorney, Agent, or Firm*—Donald M. Sell; Walter N. Kirn; Leland D. Schultz

[57] ABSTRACT

A gable-top thermoplastic coated container with controllably enhanced sealing and opening characteristics includes at least one stiffening fillet attached to the panels which form the spout. The fillet comprises a thin strip constructed of unoriented polypropylene coated with a layer of adhesive, and is bonded to at least one of the spout panels. The strip is resistant to the thermal container-sealing process, and extends along a major portion of the panel length to increase the force which may be transmitted to the top of the spout where the foldback panels are adjoined, and prevent buckling of the spout panels. An adhesive web is delaminably bonded with a controlled release adhesive to the opposite surface of the strip, and is bonded to an opposed panel by the container sealing process. Delamination from the leakproof or hermetically sealed condition occurs at the interface between the strip and the delaminable adhesive, and is accomplished with a low opening force. The strip provides additional stiffness to the spout panels, enabling relatively high forces to be transferred to the spout tip where the opening forces act to open the container spout. The spout may be opened readily without significant tearing or delamination of the spout panels.

14 Claims, 8 Drawing Sheets

GABLE-TOP CONTAINER

This application is a continuation-in-part of co-pending U.S. patent application Ser. No. 36,922 filed Apr. 10, 1987 and entitled "Gable-To Container," now U.S. Pat. No. 4,756,426 issued 07/12/88.

BACKGROUND OF THE INVENTION

1. Field of the Invention

This invention relates to packaging, and particularly to an improved package construction using a pressure sensitive adhesive tape material to improve the opening characteristics of a disposable gable-top container suitable for the packaging of liquids. More particularly, this invention relates to a blank from which the container is formed.

2. Description of the Prior Art

Containers for beverages such as milk, fruit juices, and drinks are conventionally constructed from blanks of thermoplastic coated paperboard. The most widely used of such containers have a rectangular cross-sectional body surmounted by a gable-top closure incorporating an extensible pouring spout. Blanks from which the containers are constructed are divided into a plurality of panels which are adapted to form the walls and closure members. The panels are formed and separated by score lines at which the blank is folded. Particular panels are intended to be joined together in a lapped arrangement in the completed container. Typically, those panels are pressed together and heated or exposed to high frequency radiation, to fuse the adjoining thermoplastic surfaces, forming a generally strong seal. To finally seal the filled container, two or more panels are finally joined and sealed to form a rib along the top edge of the roof panels. Exemplary of such container blanks are those shown in Alden U.S. Pat. No. 2,750,095 and Wilcox U.S. Pat. No. 3,245,603.

Containers of this type are opened for access to the contents by a two-step toggle action process. First, the gable edges of the roof panels at the front of the container are pushed outward and upward toward the rear of the container by thumb pressure, breaking the seal between the outside surfaces of the two lip panels, and breaking the seal in the rib panels surmounting the roof above the pouring spout. The gable edges are forced backward past the point at which the lip panels are joined, to nearly touch the roof panels.

Second, the gable edges are pushed forward and inward. The second stage opening forces are communicated through spout panels to the tip of the pouring spout, breaking the seal between the lip panels and the underside of the roof panels and snapping the spout outward to a pouring position.

The first step in the opening process primarily produces tension forces in the spout panels, while the second step produces compression forces, and these latter forces are transmitted over a greater distance. Thus, the second opening stage is more likely to result in bent and crumpled spout panels.

In early models of gable-top containers, the panels comprising the lips, i.e., gable rib panels of the pouring spout were bonded to the underside of the roof panels. The resulting sealed spout was difficult to open, generally requiring insertion of a tool behind the lips to separate them from the roof underside. The cardstock panels often tore or delaminated, producing an unsightly and unsanitary container In those cases where an adhesive was applied to only those panels which were to be joined, it was simple to eliminate adhesive from the spout panels to reduce the forces required to open the spout. The resulting container, of course, was not effectively sealed and was subject to leakage.

An improvement in gable-top containers to provide a hermetic seal for an extended shelf life package consists of coating the inner surface of the container blank with a foil and an overcovering layer of thermoplastic such as polyethylene. The panels to be sealed are bonded by heating the thermoplastic surface coatings to a softening or melting temperature, compressing the panels together and cooling. The use of thermoplastic coatings or foil adds some stiffness to the panels, and the container is made resistant to wicking of liquids. However, the strong bonding of the lip panels results in buckling, tearing and delamination of the cardstock upon opening the seal. Thus, the spout is difficult to open, and the opened panels are unappealing in appearance.

Polyethylene has a low modulus of elasticity, so the stiffness added by the coating is minimal.

As used in the food packaging industry, the term hermetic refers to a container designed and intended to be secure against the entry of oxygen which degrades flavor and other food properties. The term is also used to designate containers used for aseptic filling and storage, i.e., containers secure against the entry of microorganisms. The hermetic barrier of such cartons typically comprises an aluminum or other barrier film coating the inner surface, overcovered with a thermoplastic such as polyethylene. The carton wall thickness is thus increased, resulting in larger channels where the edges of overlying panels have a stepped relationship in the gable rib area, increasing the chance for leakage.

Attempts to provide an easily opened spout seal have included (a) perforations in the spout panels which tear open to expose pouring lips, (b) improved control of the sealing temperature, (c) the use of added scoreline patterns to concentrate the opening forces, and (d) the use of anti-adhesion agents, i.e., adhesives, to eliminate the sealing between panels and thus reduce the required opening forces.

The use of perforations in the spout panels has generally been unsatisfactory. Such perforations produce a spout of reduced size, which requires special sealing operations. The perforations are considered by some to be a weak point in the carton, prone to develop leaks. This type of carton spout requires external forces such as thumbnail pressure to open, and this procedure is considered unsanitary. The carton cannot be effectively closed, once opened, and shaking of the carton results in spillage.

Likewise, efforts to reduce temperature variations in the sealing process have not produced a satisfactory hermetic sealing gable-top container. Because of narrow acceptable temperature range for obtaining the desired adhesion, sealing variations persist in spite of improved temperature control. Moreover, the required opening forces generally exceed the panel strength, even where minimal sealing is achieved.

The use of novel scoreline patterns generally has not overcome the strong sealing forces of well-sealed spouts and buckling of the spout panels is common.

One method for preventing the difficulty in opening the completely bonded lip panels of polyethylene coated gable-top containers is shown in Crawford et al., U.S. Pat. No. 3,116,002. In this reference, a thin coating of a high molecular weight organo-siloxane gum is applied to the lip panels as an adhesive, that is, to prevent permanent adhesion to the panels in contact with the lip panels.

Egleston et al., U.S. Pat. No. 3,270,940 discloses the use of an anti-adhesive composition applied to both the outside and inside surfaces of the pouring lip of a gable-top container. Adhesive agents disclosed include cellulose plastic laminated to polyethylene, the latter heat-bondable to the polyethylene surface of the cardstock blank. The cellulose plastic adds insignificant reinforcing stiffness to the pouring lip because of its low modulus of elasticity.

The release properties of adhesives are generally affected by the heat sealing parameters and are inconsistent. Containers designed for hermetic use and having adhesives in the spout sealing area often require opening forces greater than the wall strength of the panels, and the spout panels buckle during the opening process.

SUMMARY OF THE INVENTION

The present invention is directed to an improvement in the formation of a package of paneled flexible material to stiffen the package material adjacent the sealed area to be opened. The result is a more reliable, consistently openable spout for gaining access to the container contents. The container may be sealed to a leakproof or even a hermetically sealed condition if desired, yet is readily opened with minimal force. The flexible material may be cardstock, plastic, or other material with a thermoplastic inner surface coating which is sealed by elevated temperature and pressure. The flexible material may include a gas-impermeable film or foil layer. A blank of the package material with scoreline-defined panels is folded into the package shape and overlying panels are sealed. A typical sealing process consists of heating with hot air to a temperature which melts or fuses the thermoplastic surface coatings, and compressing together the panels to be joined.

A container body is provided having sides, a bottom and a top suitable for the packaging of liquids. The container body in the illustrated embodiment includes a front body panel, a back body panel and first and second side panels. Bottom closure panel means is provided for closing the bottom of the gable-top container. Connected to the upper edges of the first and second side panels are the first and second roof panels, respectively. When assembled, the roof panels are oppositely disposed to converge upwardly, and are connected at their top edges to form a gable roof. The front edges of the roof panels have score lines defining subpanels which comprise first and second roof wing panels. The wing panels form the rear portion of the pouring spout. The first triangular end panel, the first and second wing panels and the panels listed below form an extensible pouring spout connected to the top of the container body.

First and second opposed, substantially triangular end panels are connected to the upper edges of the front and back body panels to extend upwardly therefrom.

A first foldback panel is connected to the first roof wing panel and to one lateral edge of the first triangular end panel. A second foldback panel is connected to the second roof wing panel and to the other lateral edge of the first triangular end panel.

A third foldback panel is connected to the other end of the first roof panel and to one lateral edge of the second triangular end panel. A fourth foldback panel is connected to the other lateral edge of the second triangular end panel, and is adapted to be connected to the second roof panel, opposite the second foldback panel.

First and second gable rib panels are connected to the upper edges of the first and second foldback panels, respectively, and extend upwardly therefrom. These gable rib panels are also connected to each other at a common line, and comprise lips of the pouring spout from which the container contents are discharged.

Third and fourth gable rib panels are connected to the upper edges of the third and fourth foldback panels, respectively, and extend upwardly therefrom.

First and second roof rib panels are connected to the upper edges of the first and second roof panels, respectively, and extend upwardly therefrom. Each roof rib panel is connected at one side thereof to one of the first and second gable rib panels.

First and second upper rib panels are connected to the upper edges of the first and second roof rib panels, respectively, and extend upwardly therefrom.

A stiffening or reinforcement fillet overlays a portion of, and is bonded to, the inner surface of at least one of the following panels:

(i) first and second gable rib panel, and (ii) first and second roof rib panel.

The fillet comprises (a) a strip of reinforcing material resistant constructed of unoriented polypropylene to deleterious effects of the conventional carton sealing process, i.e., it will not melt, or otherwise degrade at the temperature and pressure of the sealing process, (b) a first layer of high strength adhesive attached to one side of the strip, and (c) an adhesive web including a controlled release adhesive delaminably attached to the opposite surface of the strip of resistant material and adapted to seal to the panels (x) or (xx) opposite the panels overlain by the fillet, when the container is erected, closed and sealed.

Unoriented polypropylene is the preferred material for the strip in that it is dimensionally stable, even when subjected to the elevated temperatures and pressures experienced when a container is sealed. Oriented polypropylene, although having increased tensive strength, has a tendency to return to its unoriented state when exposed to temperatures (i.e., 180°-200° F.) below the sealing temperatures. This distortion of oriented polypropylene results in buckling and separation of the polypropylene from a mounting surface.

The first layer of high strength adhesive adheres to the inner surface of one of the sets of panels, strongly bonding one side of the strip to the panels, to which it remains bonded during opening of the container.

The reinforcing strip and high strength first adhesive layer of the fillet extend along a major portion of the opening force transmission line of the closed and sealed container, that is, the line between the site where opening force is applied an the intersection of the gable rib panels which receives the opening force. The gable rib panels are pushed outward along the intersection by the transmitted opening force. The strip and adhesive stiffen the panel member to which they are bonded, so that the resistance of the panel member to bending or buckling increases, and the opening forces required to open the spout are transmitted to the spout tip.

The adhesive web is delaminable from the surface of the strip at a relatively low peel strength, but remains bonded to the container panels, having a higher peel strength at the web-panel interface. The force required to delaminate the web from the strip is precisely controllable because the adhesive properties as well as interfacial area may be closely controlled. At the same time, a tight seal, including a hermetic seal, may be readily achieved even when the force required for delamination is very low. Thus, a hermetically sealed container having a very low opening force may be produced, provided the blank includes a gas-impermeable layer. The low opening force, combined with the added stiffening from the strip and strong adhesive, prevents buckling or delamination of the gable rib panels which otherwise occur during opening of such containers. Furthermore, the clean separation of adhesive web from the reinforcing strip results in a smooth nonporous inner surface of the gable rib panels, enhancing sanitation considerations. The gable rib panels do not delaminate, tear or buckle as is common in the prior art gable-top containers.

The adhesive web may be a layer of a controlled release adhesive which delaminably bonds to the strip surface at a relatively low, controllable peel strength but bonds to the panels with a higher peel strength. Preferably, the adhesive web includes two members: first, a delaminable controlled release adhesive and second, a thermoplastic ribbon to which the delaminable adhesive is bonded. The ribbon melts or softens during the container sealing operation and becomes strongly fused to the thermoplastic coating of the container panels. Thus, the thermoplastic ribbon also acts as an adhesive.

DETAILED DESCRIPTION

Figure 1:
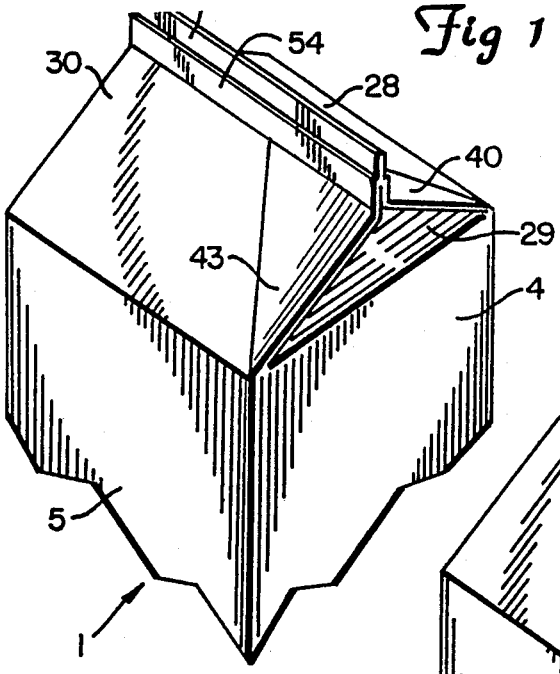
FIG. 1 is a perspective view of the upper end of a closed container formed from a blank according to one embodiment of the present invention.

Referring now to the drawings, the invention is depicted with reference to a gable-top container in which the invention is incorporated. A gable-top container is formed from a blank of paperboard or other suitable material coated on the inner planar surface, or on both the inner and outer surfaces with a thermoplastic material. The container blank is adapted to be erected and have certain panels sealed to each other by a container sealing process. Typically, the sealing process consists of compressing together the panels to be joined while those panels are at an elevated temperature. Other alternative sealing processes may also be utilized.

FIG. 1 shows a typical container 1 in a closed, sealed condition as for storage of beverages and the like. The container is self-sustaining in shape and may be hermetically sealed.

Container 1 is comprised of a series of panels, including a container body having four body panels 2–5. Front body panel 4 and second side body panel 5 are shown in FIG. 1, while rear body panel 2 and first side body panel 3, not shown, oppose panels 4 and 5, respectively, forming a container of rectangular cross-section. Usually, the cross-section is square. The bottom of the container 1 is closed. First roof panel 28 is connected to the upper edge of first side panel 3. Second roof panel 30 is connected to the upper edge of second side panel 5. When the container is in the closed condition, the roof panels 28 and 30 converge upwardly to form a gable roof construction. Second roof rib panel 54 is attached to second roof panel 30 and extends upwardly therefrom. Likewise, upper rib panel 55 is attached to roof rib panel 54 and extends upwardly therefrom.

First triangular end panel 29 is connected to the upper edge of the front body panel 4. When the container is closed, end panel 29 is folded under the gable roof formed by the two roof panels. Also shown are first roof wing panel 40 and second roof wing panel 43. The roof wing panels 40 and 43 are subpanels of roof panels 28 and 30, respectively. A second triangular end panel, not shown in this figure, is usually adapted to remain folded under the opposite gable roof, unless it is desired to open both gable ends of the container.

Figure 2:
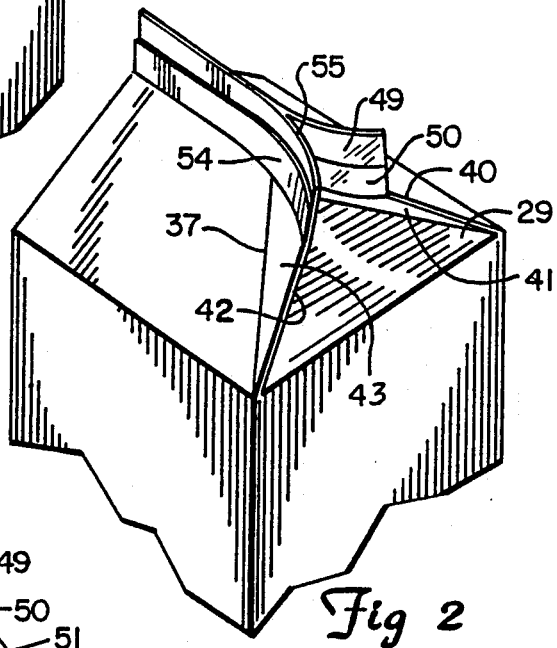
FIG. 2 is a perspective view of the container end of FIG. 1 with a partially opened rib.

FIG. 2 shows the container of FIG. 1 in which the spout has been partially opened. The first and second foldback panels 41 and 42 and overlapping roof wing panels 40 and 43 are typically pushed outward and backward with thumb pressure to break the seal between the inner surfaces of the first and second upper rib panels 49 and 55, and between the outersurfaces of the first and second gable rib panels 50 and 52, the latter not visible in this drawing. The gable rib panels are connected to the upper edge of foldback panels 41 and 42, and extend upwardly therefrom.

Figure 3:
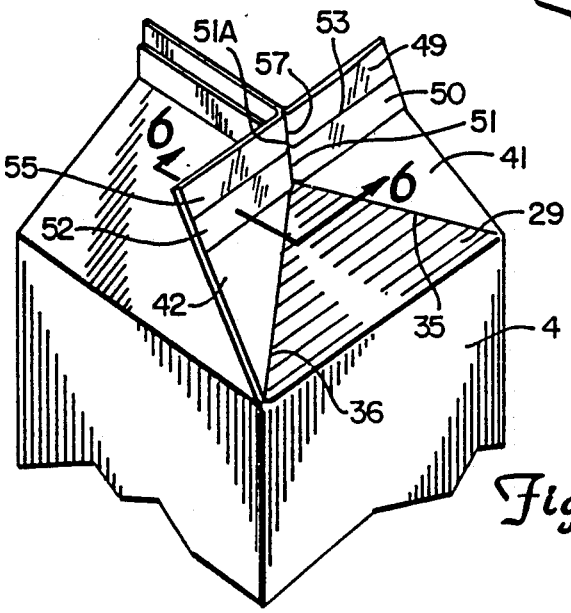
FIG. 3 is a perspective view of the container end of FIG. 1 with its sealed rib fully open and the spout panels in the closed position.

FIG. 3 shows the container at the point where foldback panels 41 and 42 have been pushed backward about 90 degrees from their sealed position. These panels are roughly triangular in shape, each having one edge defined by scoreline 35 or 36, where they adjoin the first triangular end panel 29. First and second gable rib panels 50 and 52 act as lips of the pouring spout, and meet at a common gable rib score line 51. The upper terminus 51A of the common rib score line at the free edge 53 of the pouring lip comprises the tip of the pouring spout. First and second upper rib panels 49 and 55 extend upwardly from the first and second roof rib panels 48 and 54 to a level higher than the free upper edge 53 of gable rib panels 50 and 52.

To complete the unsealing and opening of container 1, foldback panels 41 and 42 are pushed backward beyond the position shown in FIG. 3. The roof rib panels and upper rib panels will fold along line 57. The blank may or may not be scored at that location.

The gable rib panels are slightly longer than the roof rib panels. Thus, after the panels are folded backward, a subsequent forward and inward movement of wing panels 40 and 43 transmits opening forces in a toggle-like action along the wing panels and gable rib panels 50 and 52 toward the common line 51 between the gable rib panels. A component of these forces extends outward and upward from line 51 and from gable score lines 35 and 36 to pull the gable rib panels 50 and 52 away from roof rib panels 54 and 48, the latter not visible in FIG. 3, and to pull foldback panels 41 and 42 away from roof wing panels 40 and 43. Likewise, triangular end panel 29 is forced outward, and the distended panels create a pouring spout. The various score lines delineating the panels act as hinges for the panels as they are unfolded.

The force required to distend the spout in this fashion may be calculated theoretically. If the gable rib panels are looked upon as a beam which is to be buckled in the center, the force P required for buckling to occur may be described as:

$$P=CEI/(L^2)$$

where $C=()^2=9.87$ for hinged ends.

E=modulus of elasticity of beam.

I=moment of inertia of the beam.

$I=bh_3/12$ where b=width and h=thickness of the beam.

and L=length of the beam.

Analysis of the opening forces is complex. In general however, the gable rib panels, foldback panels, and roof rib panels must be relatively stiff to prevent the panels from crumpling, and transmit the applied opening forces to common line 51. The sealing forces which bond the gable rib panels to the roof rib panels are preferably only as high as required to maintain the desired leakproof or hermetic seal. Excessive bonding forces require higher opening forces to be transferred to the spout tip, necessitating greater stiffness in the spout panels to prevent crumpling of the panels during the opening process.

Certain features of this invention produce a liquid-proof spout seal which is easily opened without tearing, delamination, or buckling of the spout panel members. These features underlie the spout panel members in FIG. 3, and are not visible in that figure. These features include one or more fillets 56, shown in FIG. 4 and described in reference to the remainder of the figures.

Figure 4:
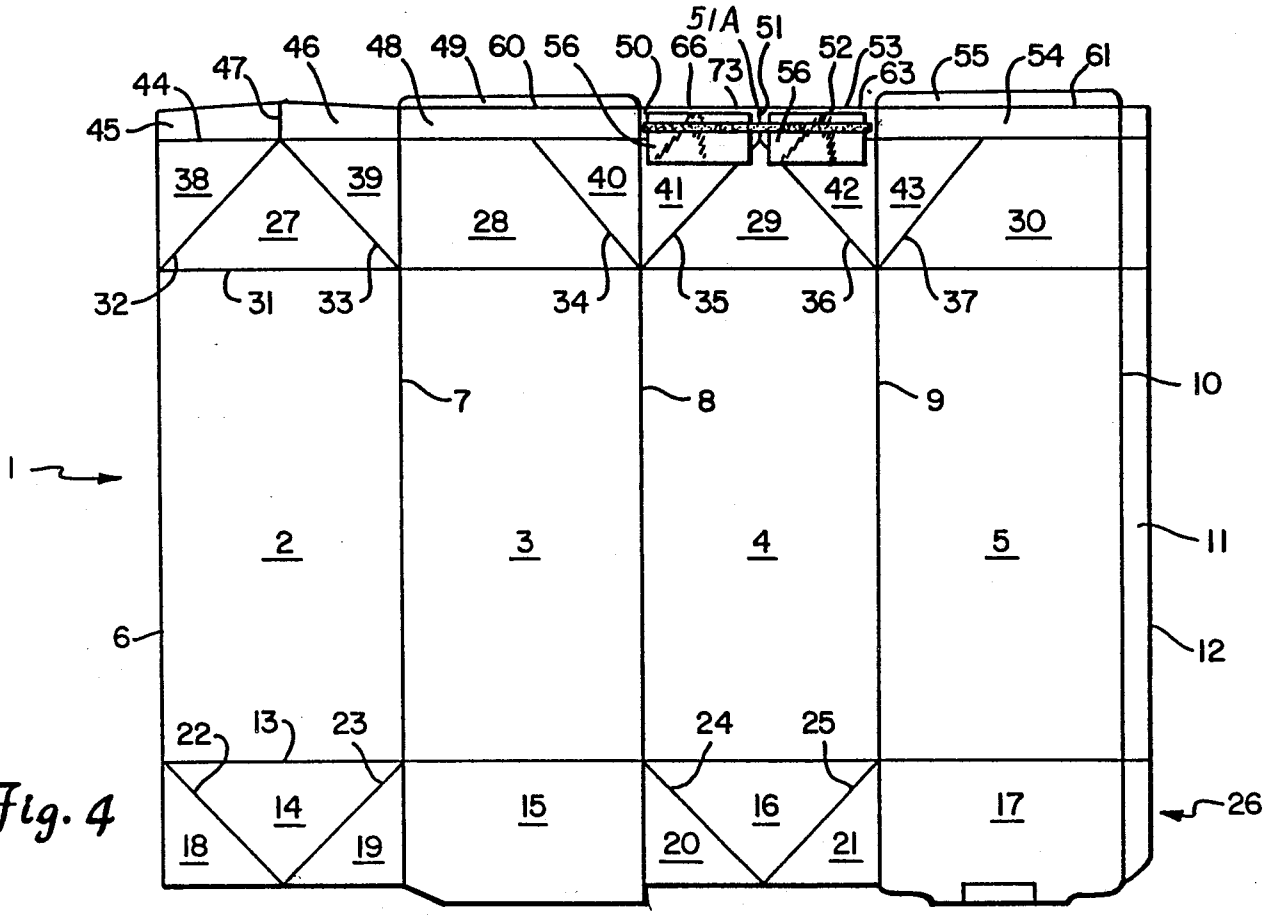
FIG. 4 is a plan view of an embodiment of the container blank according to the invention.

FIG. 4 illustrates an exemplary flat sheet material blank of this invention for constructing a gable-top container. The inner surface or face is shown, and it is coated with a thermoplastic such as polyethylene. Typically, the outer surface is also similarly coated. The sheet material may include a gas impermeable layer such as aluminum foil. An appropriate pattern of score lines divides blank 1A into a plurality of panels and sub-panels which are used as walls of the container and its closure parts when the container is erected.

The central portion of blank 1A comprises four body panels 2, 3, 4, and 5, having their lower edges along bottom score line 13, and their upper edges along top score line 31. These transverse score lines are shown as extending from blank edge 6 to opposite blank edge 12 in substantially parallel relationship across the face of the blank. Vertical score lines 7, 8, 9, and 10 transect the blank to define the lateral edges of the body panel 2, 3, 4, and 5, and other panels above the body panels. These and other score lines are not necessarily straight, but may be slightly offset in certain sectors of the blank to improve the fit of the various panels in the erected container.

In the example shown in FIG. 4, side seam flap 11 is connected to one lateral edge 10 of a body member for sealing to the edge of another body member by the container sealing process. Bottom closure means 26 is shown as a group of bottom closure panels 14 through 21 attached to the body members along bottom score line 13, and extending downward therefrom. Bottom closure score lines 22 through 25 enable bottom closure panels 14, 16, and 18–21 to be folded under closure panels 15 and 17 and sealed to provide a leakproof container bottom. Such a closure means is well-known in the art. A separately formed structure may alternatively be used to close the bottom of the container. In fact, any closure means which results in a satisfactorily tight seal may be used.

The gable top of the container is formed from a series of panels above top score line 31. First and second roof panels 28 and 30 are connected to the upper edges of the first and second side panels 3 and 5, respectively. The roof panels 28 and 30 are oppositely disposed and when erected, converge upwardly to meet along score line 44 to form a gable roof. Connected to the upper edge of the front panel 4 is a first substantially triangular end panel 29 whose two lateral edges 35 and 36 formed by score lines extend upwardly to score line 44. Similarly, second triangular end panel 27 is connected to the upper edge of back panel 2, and has lateral edges 32 and 33 which extend upwardly to score line 44.

On each side of triangular end panel 29 is a foldback panel. First foldback panel 41 is connected to triangular end panel 29 along edge 35, and to first roof wing panel 40 along score line 8. Panel 41 has a score line 44 as its upper edge. Similarly, second foldback panel 42 is connected to triangular end panel 29 along edge 36, and to second roof wing panel 43 along score line 9. It has score line 44 as its upper edge.

Similarly, third and fourth foldback panels 39 and 38 are connected to triangular end panel 27 along lateral edges 33 and 32, respectively. The third foldback panel 39 is attached to the first roof panel 28 along score line 7, and the fourth foldback panel 38 is connected to the second roof panel 30 by side seam flap 11 when the container is erected.

Attached to the upper edge of each foldback panel 38, 39, 41, and 42 along score line 44 is a gable rib panel 45, 46, 50, and 52, respectively. Similarly, attached to the upper edge of first and second roof panels 28 and 30 are first and second roof rib panels 48 and 54, respectively. First and second gable rib panels 50 and 52 are connected to each other at a common score line 51, and third and fourth gable rib panels 46 and 45 are connected to each other a common score line 47. The uppermost end 51A of line 51 is the tip of the pouring spout of the erected container.

First gable rib panel 50 is connected to first roof rib panel 48 at score line 8, and second gable rib panel 52 is connected to second roof rib panel 54 at score line 9.

First roof wing panel 40 comprises a triangular portion of first roof panel 28 defined by score lines 34, 44, and 8, and is adjacent first foldback panel 41. Second roof wing panel 43 comprises a triangular portion of second roof panel 30 defined by score lines 37, 44, and 9 and is adjacent second foldback panel 42. These roof wing panels 28 and 43 are more or less coextensive with the adjacent foldback panel when the erected container is closed.

A first upper rib panel 49 is connected to the upper edge of the first roof rib panel 48. Likewise, a second upper rib panel 55 is connected to the upper edge of the second roof rib panel 54. The score lines 60 and 61 separate the upper rib panels from the adjacent roof rib panels, and are substantially continuous with the free upper edge 53 of the first and second gable rib panels 50 and 52. The latter panels serve as lips of the pouring spout of the erected container.

The score lines may be applied to blank 1A before or after the thermoplastic coating is applied to the blank. The score lines may be applied to either surface or both surfaces of the blank. For purposes of clearer delineation of the various panels, score lines are shown in the drawings on both of the inner and outer surfaces of the blank and container.

In the embodiment shown in FIG. 4, two stiffening fillets 56 overlie portions of the first and second gable rib panels 50 and 52, and extend downwardly to overcover portion of the first and second foldback panels 41 and 42 and small upper portions of first end panel 29.

Figure 5:
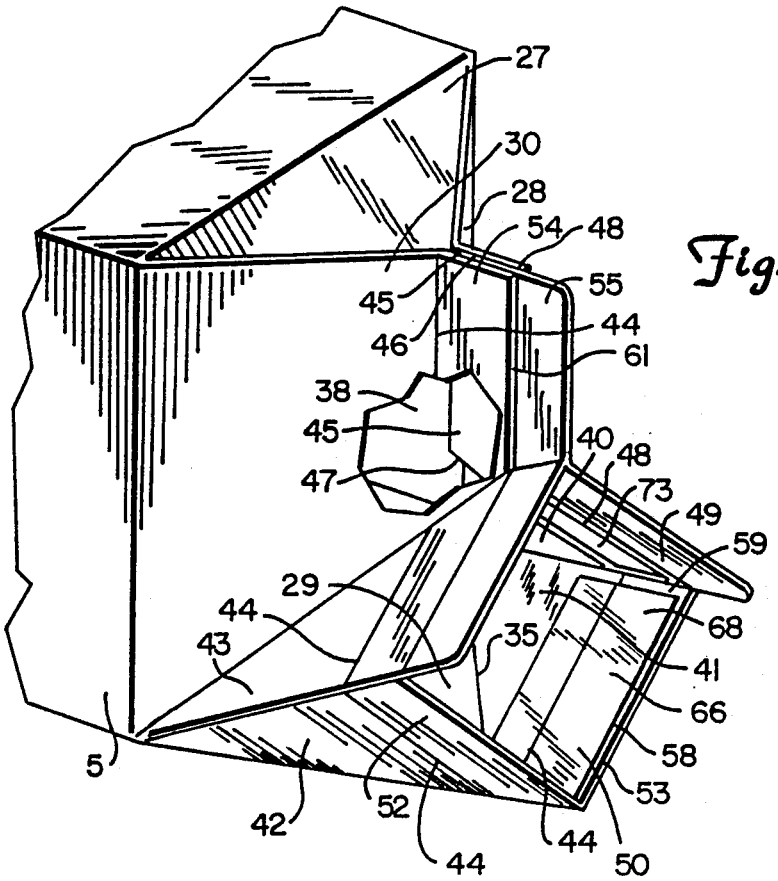
FIG. 5 is a perspective view of the upper portion of a gable-top container formed from one embodiment of a blank according to the present invention, sealed, and subsequently opened. A portion of the container is cut away to view panel members below the roof and roof rib panels.
Figure 6A:
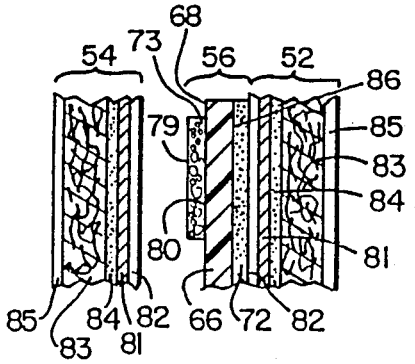
FIG. 6A is a sectional view along line 6—6 of FIG. 3, showing the gable rib panel, roof rib panel and fillet, prior to the container sealing process.
Figure 6B:
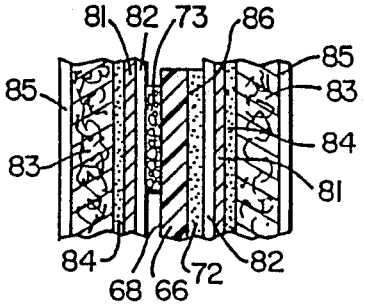
FIG. 6B is a sectional view along line 6—6 of FIG. 3, showing the gable rib panel, roof rib panel and fillet in the sealed condition.
Figure 6C:
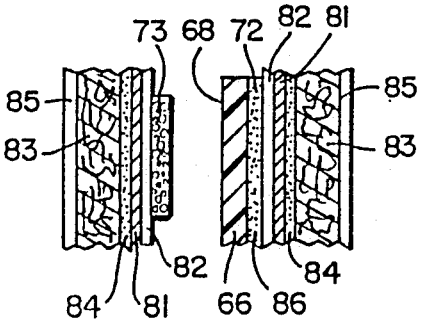
FIG. 6C is a sectional view along line 6—6 of FIG. 3, showing the gable rib panel, roof rib panel and fillet following opening of the spout seal.

As is also illustrated in an enlarged perspective view in FIG. 5 and in FIGS. 6A, 6B and 6C, each fillet 56 comprises a strip 66 of material resistant to the container sealing process, and a first layer 72 of adhesive. This adhesive layer 72 is attached to (a) a first planar surface 86 of strip 66 and to (b) the inner thermoplastic coating 82 of one or more of (x) the first gable rib panel 50, (xx) the second gable rib panel 52, (xxx) the first roof rib panel 48, and (xxxx) the second roof rib panel 54. The strip 66 of material is thus sealed to the thermoplastic inner coating 82 of one or more of these panels.

Strip 66 may be formed from any solid material which is resistant to any deleterious effect of the container sealing process, and is sufficiently rigid so that, together with adhesive layer 72, it provides sufficient strength to reinforce the panel to the necessary stiffness. Thus, strip 66 must not melt, or otherwise degrade at the temperature and pressure conditions of the container sealing process.

Figure 9:
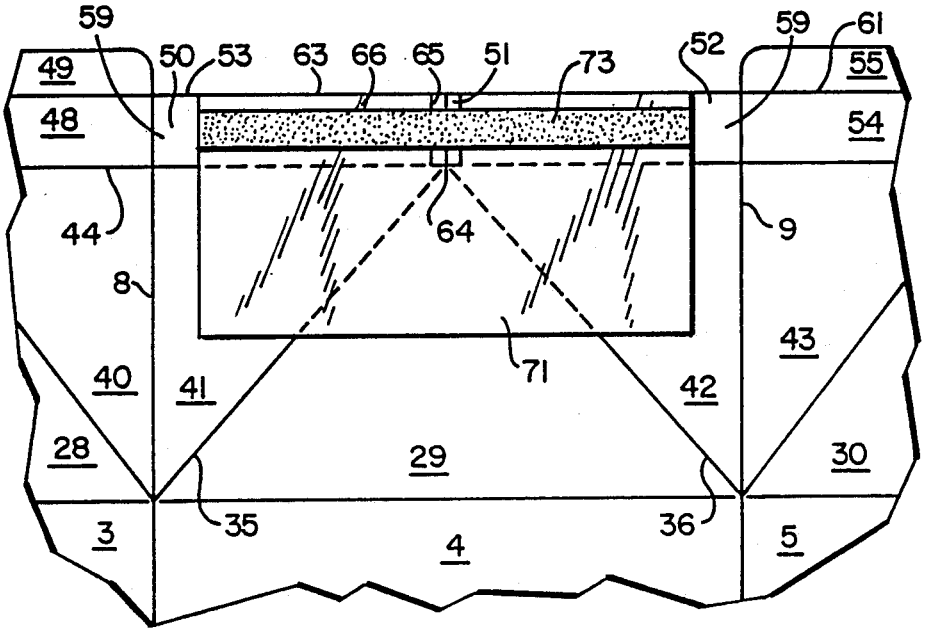
Figure 10:
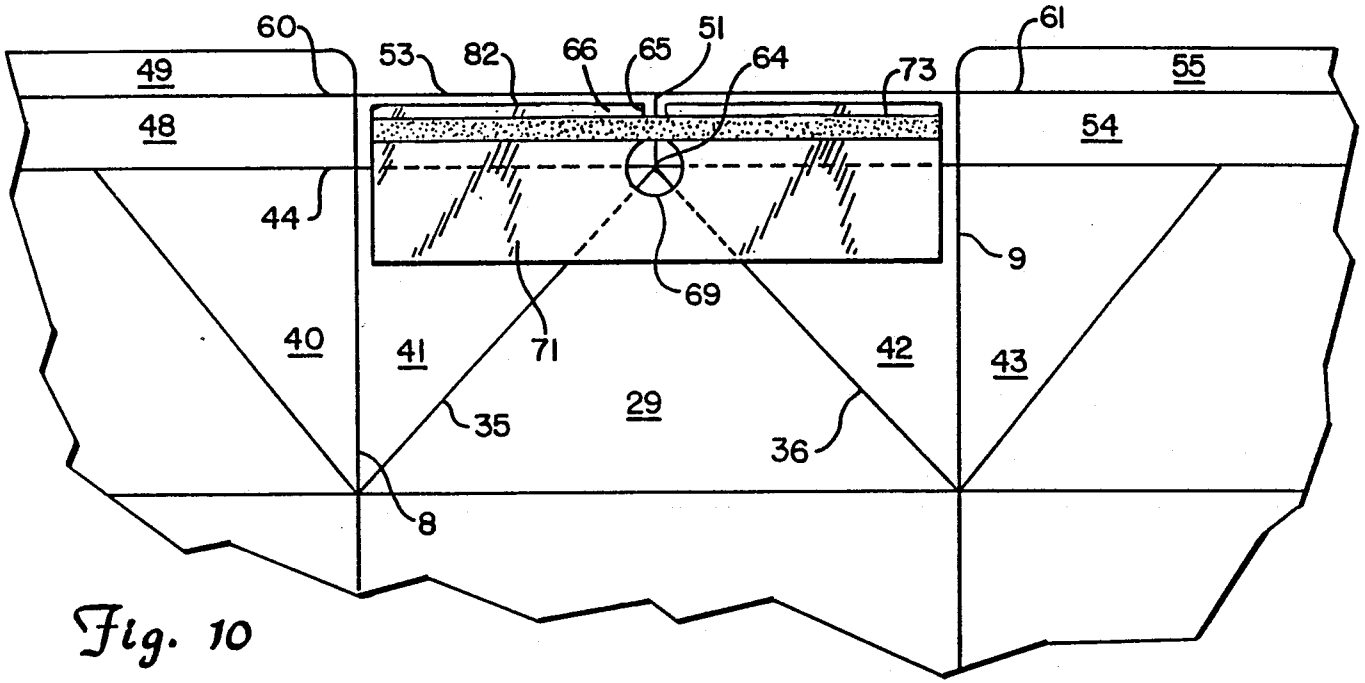
Figure 12:
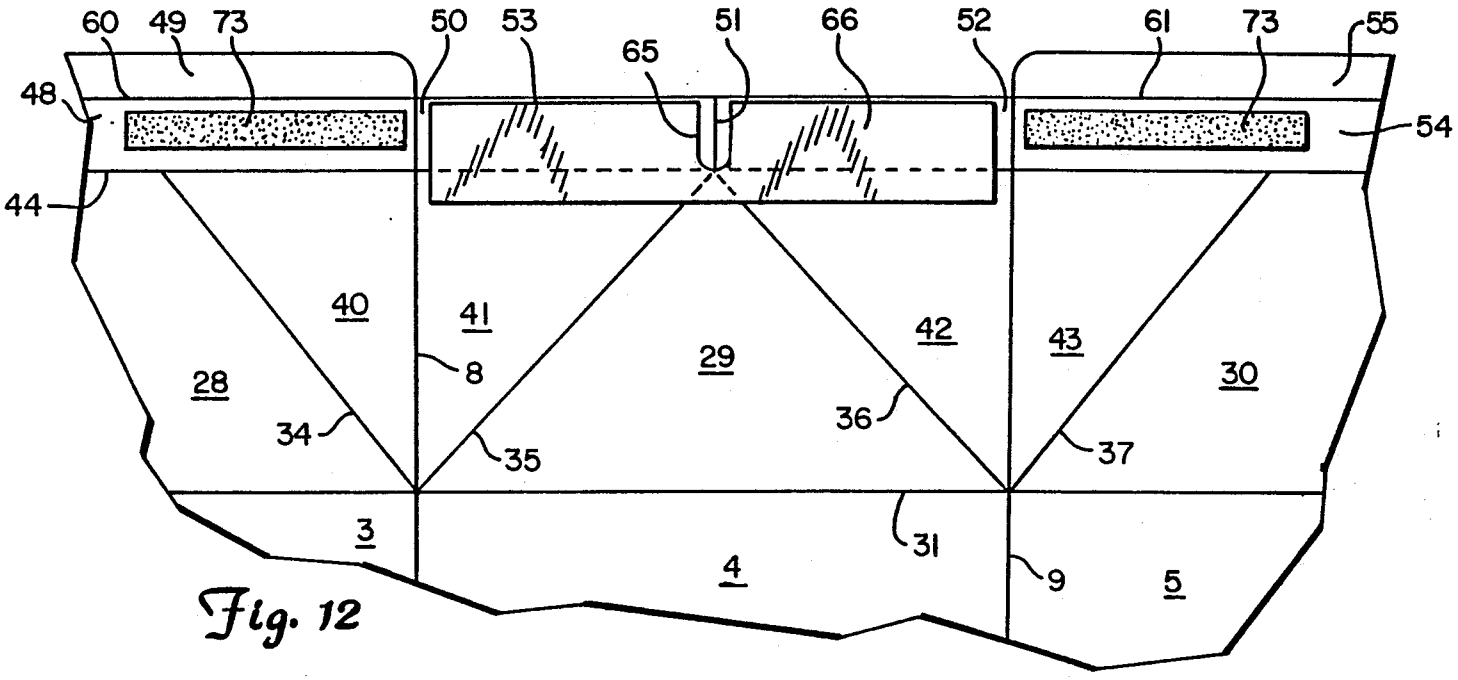

Material such as metallic foil, polyester film, and polycarbonate film are examples of strip materials which are unaffected by the temperatures used for sealing panels coated with polyethylene. Such thermoplastic coatings are typically sealed at temperatures of 250° to 400° F. (81° to 205° C.). In the most preferred embodiment of the invention, the material of the strip is unoriented polypropylane, such as that utilized as a film backing in a pressure sensitive adhesive tape marketed under the trademark "Y-8450" by Minnesota Mining and Manufacturing Company of St. Paul, Minn. A fillet constructed of unoriented polypropylene exhibits several advantages over strips constructed of other materials (i.e. as low as $0.2\times10^6$ psi). Specifically, unoriented polypropylene has a lower modulus of elasticity than polyester. Therefore, a more compliant strip may be constructed which is better able to conform to the scorelines between the pouring spout panels. Thus, a notch, such as is shown in FIGS. 9, 10 and 12 and discussed hereinafter, is not required. This simplifies the process of positioning and aligning the fillet on the panels. The optimum temperature range per bonding the unoriented polypropylene strip is 260°–320° F.

The stiffening fillet 56 further includes an adhesive web 73 including a controlled release adhesive, having a first surface 80 delaminably attached to the opposite surface 68 of strip 66. During the container sealing process, the opposite surface 79 of web 73 is bonded to the opposite panel by the sealing process conditions. This web 73 may comprise a single controlled release adhesive material which strongly adheres to the container panel coating, typically polyethylene, and bonds delaminably to strip 66 with less adhesion. When the sealed container is opened, the adhesive web 73 peels from the strip 66, leaving a smooth surfaced pouring lip. The adhesive material comprising the web of this embodiment may be a pressure sensitive adhesive such as a rubber/resin combination or which becomes bonded to the container panel surface at the container sealing conditions, achieving an adhesion strength of 5 to 50 oz/in (61 to 612 g/cm) of width.

In the preferred embodiment, web 73 comprises two members, a thermoplastic ribbon 74 and a layer 76 of controlled release adhesive delaminably attached to one side of the ribbon 74. The various embodiments of web 73 are further explained with reference to the remaining figures.

The strip 66 and adhesive layer 72 may be preformed as a tape which is applied by machine to the blank 1A. The adhesive web 73 may be preformed as part of the tape, or may be applied to strip 66 during or after the application of the tape to the blank. A web 73 comprised of a thermoplastic ribbon 74 and adhesive layer 76 may be preformed as a second tape which is applied to the strip 66 of a first tape, or to the panel opposite that to which strip 66 and layer 72 are attached. Optionally, strip 66, adhesive layer 72, ribbon 74, and adhesive layer 76 may be together preformed as a single tape to be applied to blanks 1A.

For hermetic sealing containers, the modulus of elasticity of strip 66 may be as low as $0.2\times10^6$ psi ($1.4\times10^8$ kg/m$^2$) but for materials other than unoriented polypropylene preferably is at least $0.4\times10^6$ psi ($2.8\times10^8$ kg/m$^2$).

The stiffness of the fillet 56 must be such that the panel with the attached fillet has greater stiffness than a panel without the fillet. This relationship may be expressed as follows:

$$E_2 > E_1(h_1)^3/(h_2)^3$$

where:

$E_1$ = modulus of elasticity of panel.

$E_2$ = modulus of elasticity of panel + fillet.

$h_1$ = thickness of panel.

$h_2$ = thickness of panel + fillet.

It is preferred that $E_2$ be greater than $0.2\times10^6$ pounds per square inch ($1.406\times10^8$ kg per square meter) to provide the desired stiffness.

The first adhesive layer 72 may be of such an adhesive type and thickness that when the fillet 56 is compressed between gable rib panel 50 and 52 and roof rib panels 48 and 54 during the container sealing process, a portion of the adhesive of layer 72 extrudes from between the panel or panels and strip 66 of resistant material. The extruded adhesive fills channels otherwise open to leakage and effectively seals the container. The adhesive used may be sealable by pressure, heat, or other process, but is preferably a pressure sensitive adhesive whose bond is strengthened by the heat and pressure of the container sealing process.

FIG. 5 shows a gable-top container 1A formed from the blank of FIG. 4, sealed according to the container sealing process, and subsequently opened from the closed and sealed condition. Second roof panel 30 and first roof Panel 28 converge upwardly so that their upper edges 44 meet or almost meet. Roof rib panels 48 and 54 are sealed along approximately one-half of the length of the rib structure, and enclose third and fourth gable rib panels 45 and 46. When the container is closed, common scoreline 47 between the third and fourth gable rib panels is somewhat spaced from common scoreline 51. The void between those scorelines is a vertical channel which when filled with adhesive will prevent leakage. First and second upper rib panels 49 and 55 are joined by the container sealing process. The spout panels of the rib structure are shown to have been opened by first breaking the seal between the upper rib panels 49 and 55, and then breaking the seal between gable rib panels 50, 52 and roof rib panels 48, 54. First triangular end panel 29, and first and second foldback panels 41 and 42 are folded outward t extend the pouring spout.

Stiffening fillet 56 is shown within the pouring spout, having strip 66 overlying and attached to first gable rib panel 50, and second gable rib panel 52, not visible in this view. Adhesive web 73 is shown attached to first roof rib panel 48, having delaminated from strip 66 by the opening forces applied to the container. Conforming to a preferred embodiment, the strip 66 also extends downward over scoreline 44 to overcover a portion of foldback panels 41 and 42. The advantages of such extension will be later described.

FIGS. 6A–6C and 7A–7C are enlarged cross-sectional views through the rib portion of a hermetically sealing container 1 formed from this invention, showing the panel members and an embodiment of the fillet 56 exaggerated in thickness for the sake of clarity. The panel members 54, 52 include a film or foil 81 of gas-impermeable material such as aluminum, bonded to the inside surface of fiberboard layer 83 by adhesive 84, and overcovered by the thermoplastic coating 82. The outside surface of the fiberboard 83 is shown as also being coated with a layer of thermoplastic 85.

It is understood that while the adhesive layer 72 of fillet 56 is shown as being directly attached to the gable rib panel 52, it may optionally be attached to roof rib panel 54. In other words, fillet 56 is reversed within the space between the panels.

Although fillet 56 is shown as being first attached to gable rib panel 52 by adhesive layer 72, and subsequently attached to roof rib panel 54 by web 73 during the container sealing process, the order may be reversed if desired, without changing the members that are adhesively joined. In other words, adhesive web 73 of fillet 56 may be first attached to roof rib panel 54 of blank 1A, with adhesive layer 72 subsequently bonded to gable rib panel 52 during the container sealing process. Preferably, the fillet 56 is first bonded to the gable rib panel 52 because proper placement of strip 66 and layer 72 on panel 52 is more critical than the placement of web 73 on the roof rib panel. During the container erection and sealing processes, the gable rib panels 50 and 52 may not always be precisely aligned with the roof rib panels 48 and 54.

It is to be understood that FIGS. 6A–7C apply equally to the first gable rib and roof rib panels 50 and 48, although the second gable rib and roof rib panels 52 and 54 are shown.

Turning now to FIGS. 6A through 6C, fillet 56 is shown in FIG. 6A attached to gable rib panel 52 of blank 1A. The fillet comprises, in order, a layer 72 of adhesive bonded to the inner thermoplastic coating 82 of the gable rib panel 52. The first surface 86 of reinforcing strip 66 is bonded to coating 82 by intervening adhesive layer 72. An adhesive web 73 is delaminably bonded on first surface 80 to opposite strip surface 68. Web 73 is adapted to be bonded on its opposite surface 79 to roof rib panel 54 during the container sealing process.

FIG. 6B shows the same panels 52, 54 and fillet 56, following sealing. Strong bonding forces exist between adhesive layer 72 and thermoplastic coating 82 of gable rib panel 52, between adhesive layer 72 and strip 66, and between web 73 and thermoplastic coating 82 of the roof rib panel 54. The bond between the first surface 80 of web 73 and the opposite surface 68 of strip 66 has the least strength of the fillet bonds, and web 73 is designed to cleanly separate or delaminate at surface 68 upon application of opening forces. Adhesive web 73 is designed to extrude during the container sealing process of high temperature and pressure, to penetrate areas of possible leakage between the panels and provide a leakproof or hermetic seal in the spout. The resistance to delamination of web 73 from strip 66 is relatively low, compared to the other sealing forces, so a real expansion of web 73 on surface 68 has little effect on the required opening force.

The separation or delamination is illustrated in FIG. 6C, which shows web 73 separating from strip 66 and remaining bonded to the inner thermoplastic coating 82 of roof rib panel 54. The clean separation provides a smooth inner surface on the gable rib panels 50, 52.

Figure 7A:
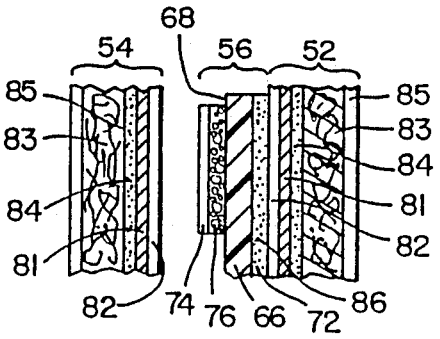
FIG. 7A is a sectional view along line 6—6 of FIG. 3, showing the gable rib panel, roof rib panel and fillet of a further embodiment, prior to the container sealing process.
Figure 7B:
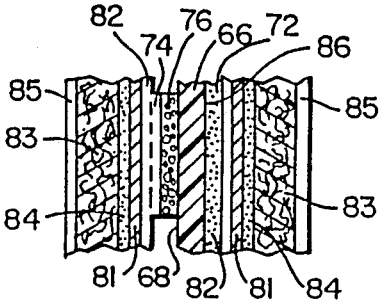
FIG. 7B is a sectional view along line 6—6 of FIG. 3, showing the gable rib panel, roof rib panel and fillet of FIG. 7A in the sealed condition.
Figure 7C:
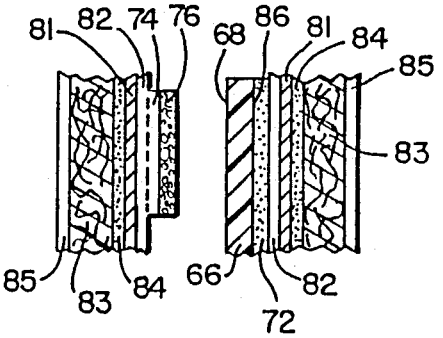
FIG. 7C is a sectional view along line 6—6 of FIG. 3, showing the gable rib panel, roof rib panel and fillet of FIG. 7A following opening of the spout seal.

FIGS. 7A–7C correspond to FIGS. 6A–6C, but show another embodiment of the web fillet 56. The web 73 of this fillet 56 is comprised of a thermoplastic ribbon 74 which is delaminably bonded to side 68 of strip 66 by a layer 76 of delaminable adhesive. During the container sealing process of elevated temperature and pressure, ribbon 74 melts and fuses to the inner thermoplastic coating 82 on roof rib panel 54 to provide a strong seal. The thermoplastic extrudes into open areas between the two panels to effectively prevent leakage, producing a seal useful for hermetic sealing containers. The extrusion which occurs is not shown in FIGS. 7B or 7C, and has little effect upon the force required for opening, because the thermoplastic will not effectively adhere to strip 66. As illustrated in FIG. 7C, the container seal is opened by separating or delaminating layer 76 from surface 68 of strip 66. The layer 76 of delaminable adhesive remains attached to the roof rib panel 54, providing a clean, smooth surface on the inner face of the gable rib panel 52.

Fillet 56 may comprise a tape having a relatively thick backing or strip 66 of a stiff material which bonds relatively weakly to the thermoplastic surface of the panels. The adhesive layer 72 may be thermoplastic in nature, but preferably is a pressure-sensitive adhesive. The latter affords easier positioning during application to the blank 1A, and does not require the application of heat for positioning. However, the thermal container sealing process has been found to significantly enhance the sealing strength of the pressure sensitive adhesives (PSAs) which were tested. Typical pressure sensitive adhesives (PSAs) can be formed into stable thick layers, if desired, and will readily extrude at the temperatures and pressures used to thermally seal polyethylene. In some cases it may be desirable to produce an extruded bead of adhesive along the edges of the fillet 56 to further enhance the sealing. In such cases, PSA's appear to work well, being extruded by the pressure of the container sealing process. The quantity of extruded adhesive may be varied by controlling the type of adhesive, the thickness of the adhesive layer, and the temperature and pressure of the carton sealing process. The quantity of extruded adhesive may be controlled to fill the small channels which typically develop along the free upper edge 53 of the gable rib panels, and provide additional sealing in the areas immediately surrounding the strip 66.

Furthermore, the space at the tip of the pouring spout, that is, the space in FIG. 5 between common line 51 and the corresponding line 47 of the third and fourth gable rib panels, usually not securely sealed in the prior art by the container sealing process, may also be controllably filled with a bead of extruded adhesive during the sealing process to enhance the seal.

Because the bead bonding the gable rib panels to the roof rib panels is relatively narrow, the seal may be broken with minimal force during opening of the spout. The adhesion of strip 66 to the container panel through adhesive layer 72 should preferably produce a peel strength greater than 50 oz. per inch of width (612 grams per cm. width) at room temperature, so that the strip 66 will remain an integral part of the panel to which it is attached, both before and after the spout panels are unsealed and unfolded. The fillet may be adhesively attached to at least one of the pouring spout panels depending upon what is desired for the particular application. A strip 66 and adhesive layer 72 attached to the roof rib panels are somewhat less effective at transferring the opening forces than when attached to the gable rib panels. However, the concomitant reduction in required opening forces resulting from this invention enables a strip 66 attached to the roof rib panels 48, 54 to satisfactorily transfer the required forces to readily open the container spout.

In this invention, the thickness of adhesive layer 72 may be made considerably greater than would be required for merely bonding strip 66 to a panel. For example, while the latter may be attained with a monomolecular layer of adhesive, with some containers this invention may require an adhesive layer exceeding 0.001 inch (0.0025 cm) in thickness for achieving desired additional stiffness and leakproof or hermetic sealing. An adhesive layer of about 0.002 inch (0.005 cm) has proven optimal for certain pressure sensitive adhesives used to seal polyethylene coated containers. With other adhesives, a thickness of up to 0.004 inch (0.0102 cm) may be used. However, in conjunction with a strip constructed of unoriented polypropylene, an adhesive layer, approximately 0.003 inches 0.008 cm) has been found to be preferred.

Strip 66 is made of a relatively stiff material which is not materially affected by the temperature and pressure of the container sealing process, that is, it will not melt, extrude, or substantially bond to the thermoplastic panel coatings at the sealing condition. The modulus of elasticity must be at least $0.1\times10^6$ psi ($0.7\times10^8$ kg/m$^2$) and is preferably at least $0.2\times10^6$ psi ($1.4\times10^8$ kg/m$^2$). Most preferably, a material with a modulus of at least $0.4\times10^6$ psi ($2.8\times10^8$ kg/m$^2$) is used for the strip 66, enabling the required additional stiffness to be achieved with a thin strip 66. Materials such as metallic foil, polyester film, and polycarbonate film may be used, at thicknesses ranging from about 0.0005 to 0.008 inches (0.0013 to 0.02 cm.), depending upon the opening force which must be transferred by the fillet and the material's modulus of elasticity.

The delaminable adhesive of web 73 or layer 76 is a pressure sensitive adhesive which provides a controlled after-sealing peel strength adhesion to the thermoplastic coating 82 or to the thermoplastic ribbon 74, of 5–50 ounces/inch (61.2–612 gram-force/cm) of width. For many applications, a peel strength of about 20 ounces-/inch (245 gram-force/cm) of width is optimal. The adhesive must be delaminable or peelable from strip 66 at a controlled release force, while maintaining its bond integrity with container panel 54. With natural rubber/resin adhesive combinations, for example, the delaminable adhesion can be closely controlled by varying the percent tackifier in the adhesive mixture to achieve the desired container opening force of about 5–7 pounds (2.3–3.2 kg). When a two-part adhesive web 73 is used, thermoplastic ribbon 74 may be comprised of the same material as the thermoplastic coatings 82 on the panels. For the common polyethylene coated containers, a ribbon material of low density polyethylene works well. Such material has a low modulus of elasticity, approximately $0.02\times10^{>6}$ psi ($0.14\times10^8$ kg/m$^2$). The ribbon material should have a melt index of 0.2 to 30 g/10 minutes, and preferably 1–2 g/10 minutes, as defined by ASTM Test No. D1238. Ribbon 74 may have a thickness of 0.001–0.006 inches (0.0025–0.015 cm), with 0.004 inches (0.001 cm) as the preferred thickness prior to sealing. During the sealing process, the ribbon 74 is extruded and fused to the panel coating, typically becoming compressed to become a much thinner member. Because of its low modulus of elasticity and its ultimate thinness, the ribbon 74 contributes little, if any, stiffness to the panels.

Ribbon 74 may be advantageously formed of thermoplastic which is different in color from the panel coatings 82. The effect of the particular sealing conditions may then be easily evaluated merely by opening a sealed container and visually determining the fusing of the differentially colored thermoplastic layers. Thus, at the correct sealing temperature, the entire colored ribbon 74 will be firmly bonded to the container panel. If the sealing temperature is too low, the colored ribbon 74 will be found to be still attached to the strip 66 by the delaminable adhesive 76. If the temperature is sufficient in some areas of the seal but insufficient in other area, ribbon 74 will be inconsistently bonded to the container panel, and delamination of adhesive layer 76 to strip 66 may even be erratic. Prior to this time, such a method for quickly and easily evaluating the seal has not been available.

In a preferred embodiment, the fillet 56 is formed on the blank 1A by machine application of two tapes. The strip 66 is the backing member of a first tape, and has one side coated with a layer of adhesive 72. Thermoplastic ribbon 74 is the backing member of a second tape, and has one side coated with a layer 76 of delaminable adhesive. The first tape is applied to the desired panels of blank 1A, and the second tape is next applied to the opposite surface 68 of strip 66 of the first tape.

While strip 66 may overcover adjacent panels below the gable rib panels, one-part or two-part web 73 is preferably restricted in application to the gable rib panels 50, 52 or roof rib panels 48, 54. The vertical width of the web is preferably at least 1/5 of the distance W between score line 44 and free edge 53, and may extend the full distance. For containers having such distance W of 0.5 inches (1.27 cm), a web width of about 0.2 inches (0.5 cm) has been found optimal. In the two-part form, web 73 may, in fact, extend above free edge 53, but upward extension exceeding 0.1W is generally not desired. Preferably such upward extension is no more than 0.05W.

FIGS. 8 through 12 show a portion of the blank 1A, including those panels which become the pouring spout. These figures depict various embodiments of fillet 56 in terms of the particular panel area or areas covered thereby. In each case, the adhesive web 73 may comprise a single layer 76 of delaminable adhesive, or may comprise a single layer 76 and a thermoplastic ribbon 74.

Regardless of the type of fillet, corresponding thermoplastic covered areas of gable rib panels and roof rib panels which are not covered by the fillet and are compressed together during the container sealing process will be bonded together, providing the coatings attain a melting or fusing temperature.

Figure 8:
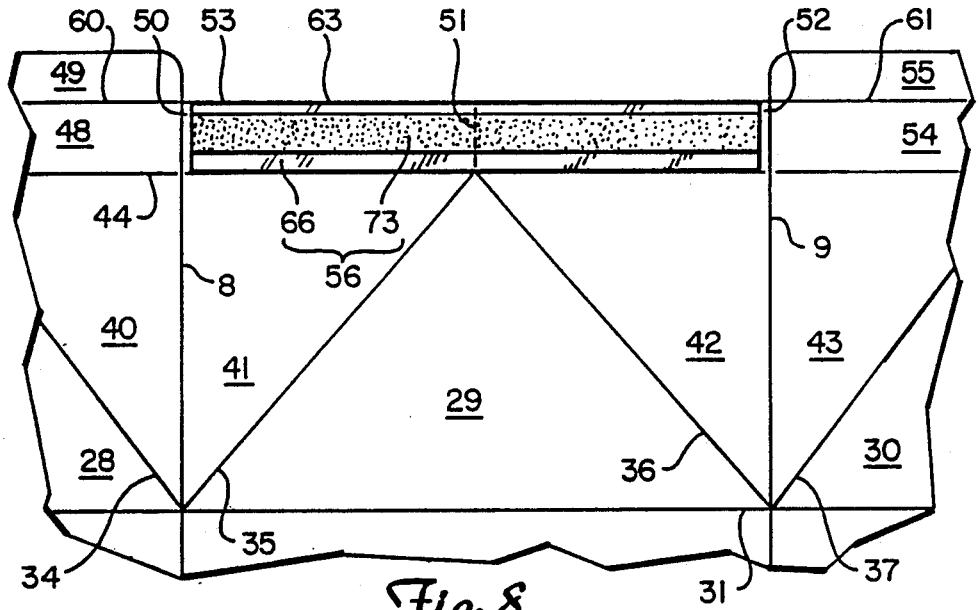
FIGS. 8 through 12 are plan views of the interior face of various embodiments of the present invention.

In FIG. 8, a single fillet 56 overcovers a portion of both gable rib panels 50 and 52. Shown are strip 66 having an underlying layer of adhesive 72, not visible, and adhesive web 73, which preferably extends from one end of the strip to the opposite end without interruption, but may also optionally extend beyond the strip ends. The web 73 is within the scorelines defining the gable rib panels 50, 52. The uppermost edge 63 of fillet 56 is generally continuous with the upper free edge 53 of the gable rib panels, but may be spaced upwardly therefrom by up to 0.2W, where W is the distance between score line 44 and free edge 53. The uppermost edge 63 of the fillet 56 may also be below free edge 53. When the uppermost edge 63 of fillet 56 is below the free edge 53 by more than 0.3 inches (0.76 cm), an excessive panel sealing area may result. This produces a strong panel-panel thermoplastic seal which may require an excessive opening force to break. In such cases, torn or delaminated panel portions may result in the directly sealed areas.

As previously depicted in FIG. 4, a separate strip 66 may be bonded to each of the gable rib panels 50, 52. In this case, adhesive web 73 preferably bridges the space between the two strips 66 to provide additional thermoplastic along common line 51, to effectively seal this area.

FIG. 9 depicts other features which may optionally be incorporated in the seal of this invention. Strip 66 and underlying layer 72 of adhesive overcover portions of both gable rib panels 50, 52, and extend downward to overcover and bond to portions of first triangular end panel 29 and first and second foldback panels 41, 42. The advantage of this downward extension 71 is evident when the container sealing process is one which affects the bonding strength of the fillet adhesive layer 72. In common heat sealing processes used to seal polyethylene coated blanks, heat is directly applied to the panels to be sealed, i.e., the rib panels. Panels below the rib panels are only incidentally heated and attain a considerably lower temperature. The sealing temperature is difficult to accurately control, and if the adhesive layer 72 softens excessively, the fillet strip 66 may slide downward, not retaining its proper alignment on the gable rib panel or panels. The portion of the fillet below the gable rib panels will be much less affected because of the lower temperature, and will maintain the original position of the strip 66, regardless of the typical temperature variations. The high adhesion of adhesive layer 72 is regained upon cooling.

The downward extention 71 also provides additional stiffness for easing the opening of the spout seal.

Each end of the strip 66 may be spaced from the roof rib panels 48 and 54 to form spaces 59. The spacing provides room for the panels to fold around the fillet at scorelines 8 and 9. Preferably, the spacing 59 between strip 66 and the roof rib panels is at least 0.01P, where P is the length of the first or second gable rib panel 50 or 52. The maximum spacing 59 is controlled by the length of strip which will provide the desired stiffness to the panels, and may be as great as 0.3P, where P is as defined above.

The figure also shows a notch in strip 66 which exposes common line 51 between the two gable rib panels 50, 52. Line 51 acts as a hinge between the gable rib panels. A notch, slot or slit in strip 66 along line 51 reduces the force required to bend the gable rib panels outward to open the spout. Thus, strip 66 may include a cut extending downwardly from the upper edge 63 of the strip, along at least a portion of the common line 51. This also enables adhesive from layer 72 and/or melted thermoplastic from the panel coating and the adhesive web to extrude through the cut, notch or slot to contact the opposite gable rib panels 45 and 46 at common scoreline 47, and bond thereto. This difficult-to-seal site is thus effectively sealed. When a notch or slot exposes the common line 51, the edge of the fillet strip may be separated from a portion of the common line by up to 0.3 inches (0.76 cm). When there are two strips 66, each overcovering a portion of one of the gable rib panels, the maximum spacing of each fillet from common line 51 is also 0.3 inches (0.76 cm). A greater spacing may result in insufficient stiffening of the panels in the vicinity of common line 51, and, in addition, the container sealing process will bond an excessive portion of exposed gable rib panel along line 51 to the corresponding roof rib panel with a thermoplastic-to-thermoplastic bond. Such a tight bond at the point where the opening forces first act to unseal the spout make such unsealing difficult. Greater force is required, and with less reinforcement, the end of the spout may bend, tear, and delaminate.

In the exemplary embodiment of FIG. 10, an aperture 69 in strip 66 and adhesive layer 72 exposes both the score line intersection 64 and common line 51. The sealing of first and second gable rib panels along common line 51 is enhanced, and the opening force is reduced. Opening forces may be further reduced by exposing scorelines 35 and 36 with slits, or by limitation of the downward extension 71 of strip 66. The edge of aperture 69 is preferably spaced from the score line intersection 64 by less than 0.3 inches (0.76 cm).

Figure 11:
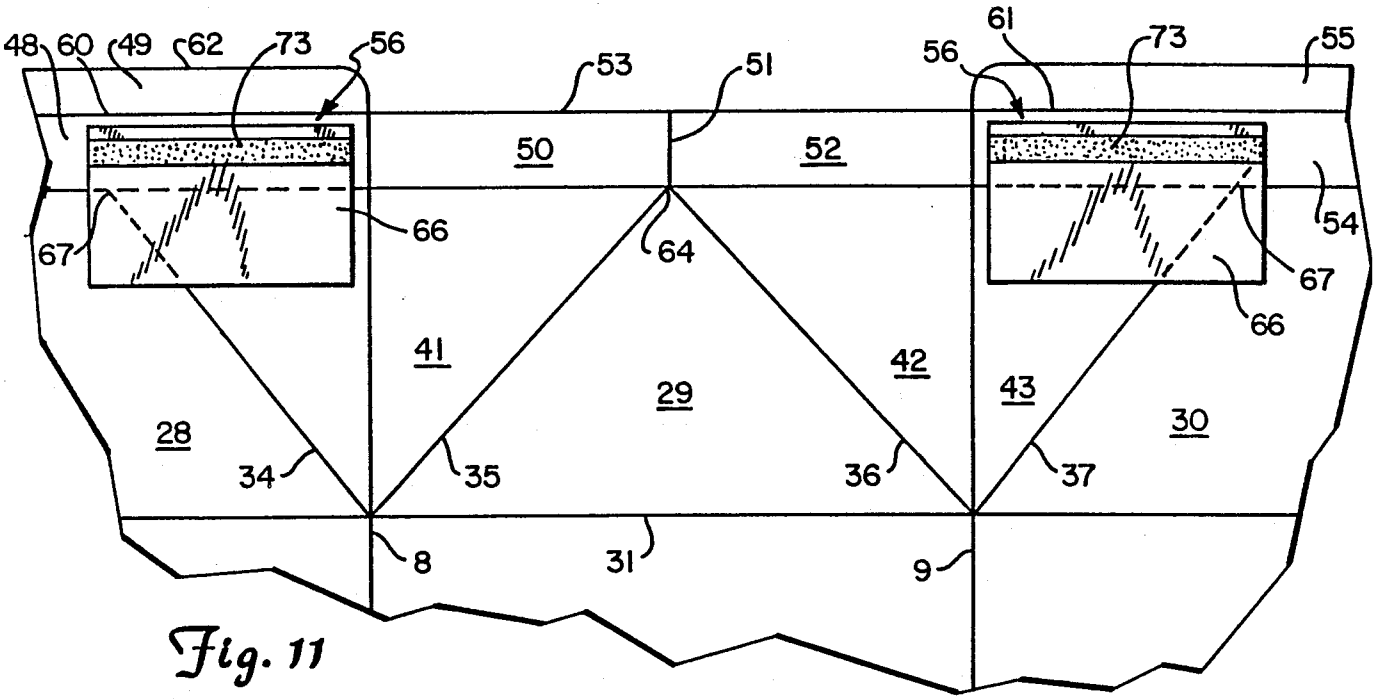

As shown in FIG. 11, a further embodiment comprises placement of fillets 56 on one or both of the roof rib panels 48 and 54. The size and shape of the fillets are such that when the seal is closed, the fillets generally correspond in coverage of the gable rib panels to fillets which would have been applied to the gable rib panels as shown in FIGS. 8–10. When applied to a container blank which includes a hermetic barrier, the container seal of this invention may be adapted to provide a hermetically sealed container under various conditions of cardstock thickness and strength as well as container size.

In FIG. 12 is illustrated a version of this invention in which strip 66 is bonded to the gable rib panels 50,52 by adhesive layer 72, and adhesive web 73 is bonded to the roof rib panels 48, 54. When the container blank 1A is erected and sealed, each of the webs 73 becomes delaminably bonded to a side of the strip 66, sealing the container spout. The preferred web 73 of this embodiment comprises a pressure sensitive adhesive (PSA).

EXAMPLE 1

Commercial hermetically sealed 0.5 gallon (1.9 liter) gable-top containers were manually opened. After folding back the wing panels, simple forward hand pressure on the roof rib panels resulted in buckling and distortion of the gable rib panels, without opening the tip of the spout at the common fold line. In all cases, inserting of a knife blade between the gable rib panels and roof rib panels near the common fold line was required to open the spout.

The container material was manufactured by International Paper Company for hermetically sealed cartons, and comprised paperboard having an aluminum film bonded to the inside surface, and both sides then coated with thermoplastic polyethylene.

Container blanks of the same material were sealed by hand, using a Liquipak TM model 010 hand sealer. Attempts to open the containers produced the same results as were obtained with the commercially sealed containers. An applied force of 15 pounds-force (6.8 kg-force) resulted in tearing and buckling of the panels, without opening the spout.

The opening force required by a previously opened hermetically sealed carton was determined to be about 2.6pounds-force (1.2 kg-force).

For the sake of comparison, a common milk carton opened from the sealed condition with an applied force of about 3.0 pound-force (1.36 kg-force), without tearing of the spout panels. This carton is sealed only to the extent of preventing gross liquid leaks, that is, the upper rib panels are thermally sealed together; a hermetic barrier is not provided between the gable rib panels and roof rib panels.

An opening force of about 3.0 to 7.0 pounds (1.36 to 3.2 kg) has been found to be generally acceptable for ½ gallon (2 liter) gable-top containers.

EXAMPLE 2

Several thermoplastic elastomer/resin PSA's were evaluated for use as layer 72 in bonding the strip 66 to the rib panels. Tapes were made by applying varied thicknesses of the PSA to an 0.003 inch (0.0076 cm) thick backing strip of polyester. Adhesive thicknesses ranged from about 0.0012 to 0.003 inch (0.003 to 0.0076 cm). Several adhesives did not adhere sufficiently to the polyester backing. It was found that, in general, a 180 degree peel adhesion of at least 50 ounces per inch (612 gram-force per cm) of tape width was required to properly seal the joint. In most cases, the heat sealing process enhanced the peel adhesion of the delaminable adhesive. Rubber resin adhesives at 0.002–0.003 inches (0.005–0.0076 cm) thickness were generally superior to other types of adhesives, providing a high peel adhesion.

The types of adhesive used in the fillets included (a) ethylene-vinyl acetate (EVA) copolymer, (b) medium density polyethylene (MDPE), and (c) a pressure-sensitive adhesive (PSA).

The modulus of elasticity was determined by measuring the deflection caused by a weight placed on the center of a simple beam formed from the cardstock. Measurements were made on the cardstock itself, on a pair of gable rib panels from a blank, and from the entire outer spout assembly comprising the gable rib panels, triangular end panel, and foldback panels. The formula used to calculate the modulus was:

$$E = fL^3/4ba^3Y$$

where

E = modulus of elasticity.

f = force applied, 0.11 pound (50 g) for most tests.

a = thickness of beam.

b = width of beam, 1.0 inch (2.54 cm).

Y = deflection, inches (cm).

L = length of beam = 3.7 inches (9.4 cm).

The results were as follows:

| Beam Material | a Thickness | Y Deflection | E, Modulus, PSI(kg/cm$^2$) |
|---|---|---|---|
| Cardstock (unreinforced) | 0.027 in. (0.069 cm) | 0.18 in. (0.46 cm) | 393,000 (2.76 × 10$^8$) |
| Cardstock with transverse scoreline. (f = 10 g because of reduced modulus) | 0.027 in. (0.069 cm) | 0.33 in. (0.84 cm) | 28,000 (0.2 × 10$^8$) |
| Cardstock with fillet of 0.004 in. (0.010 cm) polyester and 0.002 in (0.005 cm) EVA adhesive (Scotchpak TM 26 tape) | 0.036 in. (0.091 cm) | 0.090 in. (0.23 cm) | 332,000 (2.33 × 10$^8$) |
| Cardstock with fillet of 0.002 in. (0.005 cm) polyester and 0.003 in. (0.0075 cm) PSA | 0.032 in. (0.079 cm) | 0.12 in. (0.30 cm) | 390,000 (2.7 × 10$^8$) |
| Spout panels, not preflexed | 0.027 in (0.069 cm) | 0.080 in. (0.20 cm) | 885,000 (6.2 × 10$^8$) |
| Spout panels, preflexed | 0.027 in. (0.069 cm) | 0.21 in. (0.53 cm) | 337,000 (2.4 × 10$^8$) |
| Polyester Film (Literature Value) | | | 400,000 (2.8 × 10$^8$) |

The results indicate that the modulus of elasticity is approximately the same, i.e., $0.4 \times 10^6$ psi ($2.8 \times 10^8$ kg/m$^2$) for preflexed panels, either with or without the added fillet.

Buckling forces were calculated form the data of Table 2 using $$P_{crit} = CEh^3b/12L^2,$$

where $P_{crit}$ is the forward-directed force merely required to open the preflexed spout from a closed but unsealed condition, lb-force;

C is p$^2$;

E is the modulus of elasticity, approximately $0.4\times10^6$ psi;
h is thickness, 0.027 inches (0.069 cm);
b is width, 1.0 inch (2.54 cm); and
L is length, 3.7 inches (9.40).

The calculated force required to open the unsealed spout of unreinforced cardstock was 0.5 pounds (0.23 kg.).

The force carried by both of the unreinforced gable rib panels prior to buckling was calculated to be 1.9 pounds (0.86 kg.), using L=1.85 inches. This leaves 1.9−0.5=1.4 pounds (0.64 kg.) of force for breaking the bond at the tip of the spout.

Reinforcement of the gable rib panels with a 0.002 inch (0.005 cm) thick polyester strip and 0.002 inch (0.005 cm) layer of PSA adhesive provided a higher calculated available force of 2.9−0.5=2.4 pounds for breaking the bond at the spout tip. In this case, the net panel thickness was 0.031 inches (0.079 cm.).

Reinforcing the gable rib panels with 0.004 inch (0.010 cm) thick polyester and a 0.002 inch (0.005 cm) thickness of EVA adhesive provided a calculated available force of 4.6−0.5=4.1 pounds (2.09 kg.) for breaking the bond at the spout tip. In this case, the net panel thickness was 0.036 inches (0.142 cm). Thus, as a thicker, stiffer reinforcement strip is added, the applied forward-directed opening force available for opening the spout tip greatly increases.

Measurements were made of the force required to open a previously opened gable top hermetic sealing carton, using a spring gauge. The average measured force of 2.4 pounds (1.09 kg.) included the force required to buckle the extreme tip of the unreinforced spout, that is, the common fold line of the gable rib panels. Thus, the calculated value of the force transmitted by the unreinforced spout panels is only 1.9 pounds (0.86 kg.), nearly equal to the measured force of 2.4 pounds (1.09 kg) required to open the previously opened carton. This demonstrates that an increase in joint strength (e.g., a better seal) over that of the opened spout will result in buckling of the cardstock when opening forces are applied to the spout panels. On the other hand, when the gable rib panels were reinforced with a fillet according to this invention, the added stiffness provided an available opening force greater than 2.4 pounds to the common fold line, and the containers were opened without buckling or delamination of the panels.

The required thickness, width, and length of the strip 66 to provide the desired stiffness for opening may be calculated from the above equation, when the modulus of elasticity of the strip material is known. In general, polyester strips of 0.001–0.006 inch (0.0025–0.015 cm) thickness have been found to work, with strip thickness of 0.002–0.004 inch (0.005–0.01 cm) being preferred.

The effects of several variables upon ease of opening were subjectively evaluated. Ease of opening was enhanced by (a) an increase in gable rib area covered by the fillet, (b) fillets of greater stiffness, (c) cutting, notching or slotting the fillet strip 66 along the common fold line between the gable rib panels, (d) leaving uncovered the score line intersection 64 where the triangular end panel 29 touches the common fold line 51, and (e) a reduction of gable rib area which is permitted to thermally seal to the roof ribs.

EXAMPLE 3

A tape was made using a strip of 0.003 inch (0.0076 cm) thick polyester as the backing material. A 0.002 inch (0.005 cm) layer of tackified rubber resin adhesive was applied to one surface of the strip for bonding the strip to the gable rib panels of a ½ gallon container. A 0.0002 inch thick layer of Elvax TM 260 ethylene-vinyl acetate copolymer (EVA) adhesive was applied to the opposite strip surface as a delaminable adhesive web.

The tape was applied to the gable rib panels of a container blank described in Example 1. A container was erected from the blank and thermally sealed. The container satisfied the requirements of an environmental seal, i.e., (a) the tape remained at the desired location on the blank panels during the container sealing process, (b) the spout opening was fully sealed by the sealing process, (c) the added stiffness enabled opening of the spout without buckling, tearing, or delamination of the panels, at a relatively low opening force of 6–7 pounds (2.7–3.2 kg), and (d) the spout was opened by delamination of the EVA adhesive from the strip, the EVA adhesive remaining attached to the roof rib panels.

EXAMPLE 4

Two tapes were prepared for making a fillet in the spout of a gable top container. The first tape comprised an 0.003 inch (0.0076 cm) thick polyester backing as a strip 66, with a 0.002 inch (0.005 cm) layer of a tackified rubber resin adhesive coated on one surface. The second tape was an adhesive web comprising an 0.25 inch wide by 0.004 inches thick (0.64 cm by 0.01 cm) ribbon of low density polyethylene (LDPE), blue in color and having a melt index of about 1–2 g/10 minutes, coated on one surface with a delaminable adhesive comprising a natural rubber/resin PSA.

The two tapes were applied to a container blank made by International Paper Company for hermetic sealing. The first tape, 1.5 inches (3.81 cm) wide and notched to expose the common line 51 between the panels, was applied to the gable rib panels. The delaminable adhesive of the second tape was then applied to the opposite surface of the strip 66 to bond the second tape to the first tape. The location of the tapes was as shown in FIG. 9. A carton was then formed from the taped blank and thermally sealed. The resulting hermetic seal was readily opened, without tearing or delamination of the gable rib panels, with an opening force less than 7 pounds (3.2 kg). The opening forces elaminated, in a clean separation, the delaminable adhesive layer from the strip, producing a smooth strip surface.

Additional blanks sealed at lower temperatures were opened. The effectiveness of the sealing temperature was readily determined by noting the integrity of the bond between the blue polyethylene ribbon and the aluminum colored roof rib panels.

EXAMPLE 5

There are no standard tests for evaluating the seal integrity of "hermetically sealed" containers. However, a dye penetration test was performed on "hermetic sealing" cartons both with and without a fillet attached to the gable rib panels. Several configurations of the fillet were tested. The dye comprised 1.2 grams of Rhodamine B in 600 grams of isopropyl alcohol. The dye solution was introduced into an inverted carton having its gable-top sealed, and held for 10 minutes. The solution was then poured out and the carton rinsed with water. The spout was opened and the degree of dye penetration into the seal area was noted. Containers formed from blanks without the fillets of this invention and sealed conventionally to form "hermetic seals" could not be opened without directly applying force to the inside of the spout. Tearing and delamination resulted. All of the containers formed from blanks of this invention were easily opened without significant tearing or delamination of the spout panels. Little dye penetration was noted in any of the opened container spouts, but the penetration was greater in containers without the fillet or fillets.

EXAMPLE 6

An unoriented polypropylene adhesive tape having a polyethylene sealing tape attached, was evaluated as a stiffening fillet with a sealing layer in a one-half gallon gable top container blank, which was then heat sealed with a Liquidpak Model 010 heat sealer a Liquipak.

The combined tape was applied to the inside of the spout flush to the spout edge. The fillet was one inch wide and three inches long and was centered on the spout tip. No notch was cut in the fillet.

The tape had a 0.0035 inch thick unoriented polypropylene backing and a 0.003 inch thick rubber/resin pressure sensitive adhesive. A 0.2 inch wide piece of low density polyethylene was heat sealed to the upper edge of the polypropylene backing. The polyethylene was 0.004 inches thick.

The carton was opened in a normal manner and a spring gauge measured the opening force at 6.8 pounds. A similar carton, without the fillet, would have buckled instead of opening.

The polyethylene sealing layer bonded to the back of the spout and filled the gaps and channels in the spout. The joint separated at the polypropylene/polyethylene interface during opening.

While the present invention has been particularly set forth in terms of specific embodiments thereof, it will be understood in view of the instant disclosure that numerous variations upon the invention are enabled to those skilled in the art, which variations yet reside within the scope of the present teaching. Accordingly, this invention is to be broadly construed and limited only by the scope and spirit of the claims now appended hereto.

What is claimed is:

1. A sheet material blank for constructing a sealed gable-top with a thermoplastic inner surface coating responsive to a container sealing process, said blank comprising:

(a) a container body having sides, a bottom and a top;

(b) an extensible pouring spout including:

first and second substantially triangular end panels connected to said container body top, first and second foldback panels, said first foldback panel connected to one lateral edge of said first triangular end panel, and said second foldback panel connected to another lateral edge of said first triangular end panel, a first roof wing panel adjoining said first foldback panel and connected thereto, a second roof wing panel adjoining said second foldback panel and connected thereto, third and fourth foldback panels, said third foldback panel connected to a first roof panel and to one lateral edge of said second triangular end panel, and said fourth foldback panel connected to another lateral edge of said second triangular end panel and adapted to be connected to a second roof panel, first and second gable rib panels connected to upper edges of said first and second foldback panels, respectively, to extend upwardly therefrom, having upper edges and lateral edges, and connected to each other at a common line, third and fourth gable rib panels connected to upper edges of said third and fourth foldback panels, respectively, and to each other, first and second roof rib panels connected to upper edges of said first and second roof panels, respectively, each said roof rib panel connected at one side thereof to one of said first and second cable rib panels, first and second upper rib panels connected to upper edges of said first and second roof rib panels, respectively, and (c) at least one stiffening fillet overlying a portion of and bonded to an inner surface of at least one of said pouring spout panels for simultaneously stiffening said overlain panel to transfer applied opening forces therealong for opening at a controlled low opening force, said fillet comprising:

a strip of material resistant to the temperature and pressure of said container sealing process, said strip being constructed of unoriented polypropylene, a first layer of adhesive attached to a first surface of said strip and to said inner surface of said at least one said panel for bonding said strip thereto, and an adhesive web including a controlled release adhesive delaminably attached to the opposite surface of said strip and adapted to bond by said container sealing process to another of said pouring spout panels wherein said opening forces transmitted along said strip delaminate said adhesive web from said opposite surface of said strip.

2. The blank according to claim 1, wherein: said first layer of adhesive is of a material which can be partially extruded from said fillet during said container sealing process to form a bead of extruded adhesive along said upper and lateral edges of said at least one said panel, to seal said at least one panel to another of said panels.

3. The blank according to claim 1, wherein: said blank is coated on its inner surface by a thermoplastic material for forming into a container by a container sealing process of heat and pressure.

4. The blank according to claim 1, wherein: said blank is adapted to be formed into a container by a container sealing process at a temperature of 260°–320° F. wherein panels to be sealed are compressed together.

5. The blank according to claim 1, wherein: said fillet comprises a tape comprised of said strip having a pre-applied first adhesive layer on one side thereof and a pre-applied layer of controlled release adhesive delaminably bonded to the opposite side thereof.

6. The blank according to claim 1, wherein: said first layer of adhesive comprises one of a pressure sensitive adhesive and a thermoplastic material.

7. The blank according to claim 1, wherein: said controlled release adhesive is an ethylene vinyl acetate copolymer.

8. The blank according to claim 1, wherein: said controlled release adhesive is a rubber-resin adhesive.

9. The blank according to claim 1, wherein: said strip has a modulus of elasticity of at least $0.2\times10^6$ psi.

10. The blank according to claim 1, wherein: said adhesive web comprises:

a thermoplastic ribbon bondable on a first surface to said at least one panel by said container sealing process, and a layer of controlled release adhesive delaminably bonded to said opposite surface of said strip and bonded to the opposite surface of said thermoplastic ribbon, wherein said opening forces transmitted along said strip delaminate said layer of controlled release adhesive from said opposite surface of said strip..

11. The blank according to claim 10, wherein: said thermoplastic ribbon comprises low density polyethylene.

12. A hermetically sealed gable-top container for extended shelf life having a thermoplastic inner surface coating, said container comprising:

(a) a container body having sides, a bottom and a top;

(b) an extensible pouring spout including:

first and second substantially triangular end panels connected to said container body top and extending upwardly therefrom, first and second foldback panels, said first foldback panel connected to one lateral edge of said first triangular end panel, and said second foldback panel connected to another lateral edge of said first triangular end panel, first roof wing panel adjoining said first foldback panel and connected thereto, a second roof wing panel adjoining said second foldback panel and connected thereto, third and fourth foldback panels, said third foldback panel connected to a first roof panel and to one lateral edge of said second triangular end panel, and said fourth foldback panel connected to another lateral edge of said second triangular end panel and connected to a said second roof panel, first and second gable rib panels connected to upper edges of said first and second foldback panels, respectively, and extending upwardly therefrom, and to each other at a common line, third and fourth gable rib panels connected to upper edges of said third and fourth foldback panels, respectively, and to each other, first and second roof rib panels connected to upper edges of said first and second roof panels, respectively, each said roof rib panel connected at one side thereof to one of said first and second gable rib panels, first and second upper rib panels connected to the upper edges of said first and second roof rib panels, respectively, and (c) at least one stiffening fillet disposed between and adhesively bonded to an inner surface of at least one of said pouring spout panels for stiffening said panel to transfer applied opening forces therealong and for controlling the force required to open said container, said fillet comprising:

a strip of material constructed of unoriented polypropylene resistant to the temperature and pressure of said container sealing process, a first layer of adhesive disposed between a first surface of said strip of material and said at least one panel and another of said panels, and adhesively joining said strip to said panels; and an adhesive web including a controlled release adhesive delaminably bonded to the opposite surface of said strip and bonded to an opposed panel, wherein said opening forces transmitted along said strip delaminate said adhesive web from said opposite surface of said strip.

13. The container according to claim 12, wherein: said adhesive web is bonded to another of said panels by said container sealing process.

14. The container according to claim 12, wherein: said adhesive web comprises:

a thermoplastic ribbon bonded on a first surface to said other one of said panels by said container sealing process, and a layer of controlled release adhesive bonded to the other surface of said ribbon, and delaminably bonded to said opposite surface of said strip.

* * * * *

UNITED STATES PATENT AND TRADEMARK OFFICE

CERTIFICATE OF CORRECTION

PATENT NO. : 4,869,372

DATED : September 26, 1989

INVENTOR(S) : GREGORY R. WYBERG

It is certified that error appears in the above-identified patent and that said Letters Patent is hereby corrected as shown below:

In the Abstract, line 10; "top" should read --tip--.

Col. 1, line 68; insert a --.-- after the word "container".

Col. 2, line 40; "adhesives" should read --abhesives--.

Col. 3, line 1; "adhesive" should read --abhesive--.

Col. 3, line 7; "Adhesive" should read --Abhesive--.

Col. 3, line 13; "adhesives" should read --abhesives--.

Col. 7, line 32; insert --pi-- between the brackets "()".

Col. 11, line 28; insert an --o-- after the letter "t".

Col. 17, line 22; "inserting" should read --insertion--.

Col. 18, line 59; "form" should read --from--.

Col. 20, line 49,50; "elaminated" should read --delaminated--.

Col. 21, line 19; "Liquidpak" should read --Liquipak--.

UNITED STATES PATENT AND TRADEMARK OFFICE

CERTIFICATE OF CORRECTION

PATENT NO. : 4,869,372

DATED : September 26, 1989

INVENTOR(S) : Gregory R. Wyberg

It is certified that error appears in the above-identified patent and that said Letters Patent is hereby corrected as shown below:

Col. 21, line 19; delete the words "a Liquipak".

Col. 21, line 48; insert --container-- after the words "gable-top--.

Col. 22, line 15, "cable" should read --gable--.

Col. 23, line 41; delete the word "said".

Signed and Sealed this

Second Day of July, 1991

*Attest:*

HARRY F. MANBECK, JR.

*Attesting Officer*

*Commissioner of Patents and Trademarks*